United States Patent [19]

Caley

[11] Patent Number: 4,976,053

[45] Date of Patent: Dec. 11, 1990

[54] AUXILIARY EQUIPMENT ATTACHMENT ADAPTER

[76] Inventor: Jeffrey H. Caley, P.O. Box 1054, Exeter, N.H. 03833

[21] Appl. No.: 404,268

[22] Filed: Sep. 7, 1989

[51] Int. Cl.[5] ..... E01H 5/06

[52] U.S. Cl. ..... 37/231; 172/273; 280/416.2; 403/14; 403/327; 403/330

[58] Field of Search ..... 37/231; 172/272, 273, 172/274; 280/408, 416.2, 481; 403/13, 14, 327, 330

[56] References Cited

U.S. PATENT DOCUMENTS

| | | | |
|---|---|---|---|
| 3,542,399 | 11/1970 | Myers | 280/416.2 X |
| 3,987,562 | 10/1976 | Deen et al. | 37/231 |
| 4,345,870 | 8/1982 | Anderson et al. | 172/272 X |
| 4,383,793 | 5/1983 | Weir | 403/14 X |
| 4,597,205 | 7/1986 | Guest | 172/273 X |

FOREIGN PATENT DOCUMENTS

| | | | |
|---|---|---|---|
| 1262096 | 12/1961 | France | 172/272 |

*Primary Examiner*—Randolph A. Reese
*Assistant Examiner*—Arlen L. Olsen
*Attorney, Agent, or Firm*—Lee A. Strimbeck

[57] ABSTRACT

An auxiliary equipment attachment adapter, to be used in pairs, semipermanently attaches to the customary mounting fixtures on a vehicle for commonly available equipment including snow plows. The adapter has open horizontally diverging jaws, upwardly inclined to direct the attachment plate of the equipment to be attached into a retaining slot of the adapter. The equipment is modified by having a retaining bar placed between its attachments plates to engage a latch that holds the attachments plates in their retaining slots. The rearward portion of the adapter is an I-beam that rigidly encompasses the mounting fixtures of the vehicle and is pinned thereto through the web of the I-beam. This adapter and method provides a safe and easy method for engaging and disengaging attachments by one person from within the cab of any vehicle with no manual positioning of the attachment from outside the vehicle.

3 Claims, 2 Drawing Sheets

AUXILIARY EQUIPMENT ATTACHMENT ADAPTER

The present invention is an adapter, usually used in pairs, for effecting horizontal and vertical alignment and ready attachment of various attachments including snowplows to a vehicle, but not limited to snow plows as most attachments for auxiliary equipment are similar and easily modified to utilize this adapter.

BACKGROUND

A prior art search of the present invention reported sixteen patents of which the following were most germane:

1,867,187-Soule et al,
3,150,884-Drott et al,
3,410,008-Standfuss,
3,659,362-Bell, and
3,987,562-Deen et al.

Standfuss is perhaps most relevant but it will be noted that his guide/coupling mechanism is semipermanently affixed to the frame of the vehicle by bolts and the range for vertical and horizontal guidance is limited.

INTRODUCTION

Attachments such as snowplows are desirably easily attached and removed from the vehicle so that the vehicle can be free for other uses when use of the attachment is not required. Most attachment frames and mounting mechanisms are designed to accomplish this to a greater or lesser extent.

The Fisher plow arrangement is perhaps the most common. However, as manufactured and sold, the Fisher and similar plow frames and mounts leave much to be desired in as much as they are difficult to align and secure to the vehicle. The plows have a considerable weight and can not be shifted around easily.

There have been many proposals for permitting the vehicle to be driven up to and engaging an attachment automatically by having some sort of guidance and latching system that overcomes horizontal and vertical misalignment as the vehicle approaches attachment or the snow plow frame and coupling mechanism. Such proposals, however, have not found acceptance on the market for many reasons. For example, they may require the manufacturer to modify the frame portion of the coupling mechanism which the manufacturer may not wish to do and/or require special coupling fixtures to be placed on the vehicle frame.

THIS INVENTION

The present invention is addressed to this problem and proposes an adapter coupling that may be semipermanently pinned to the standard or customary mounting fixture attached to the vehicle. This adapter has open, diverging jaws that overcome a considerable amount of misalignment between the vertical and horizontal so that a vehicle in approaching an attachment to pick it up can do it so readily without a great deal of time being wasted trying to secure an exact closing alignment. The adapter of this invention is usually used as a pair. The acquiring jaw or mouth of the adapter fits the usual plate or guide affixed to the frame of the attachment although it is necessary to provide on the plate or guide a horizontal bar so that the adapter can effect vertical alignment.

In brief compass, the present invention is an adapter effecting ready horizontal and vertical alignment and attachment of a snowplow or auxiliary piece of equipment to a vehicle, the equipment having left and right plates extending rearwardly for attachment to a vehicle and the vehicle having couplings mating with the plates and attaching thereto normally by a means of a horizontal pin. The adapter of this invention is designed to be interposed between one of the plates and its mating coupling to interconnect the two. With slight modifications in the jaw configuration it can be used with most known commercially available plows such as the Myers, Western and Diamond besides the Fisher.

The present adapter comprises:

a. A horizontal cross bar affixed to the plate with which the adapter mates;
b. Two vertical sidewalls diverging towards the plate to a horizontal opening at the front thereof of at least four and preferably at least six inches and closing at the other end to a vertical slot of less than 1.1 inches. The inner of the two vertical sidewalls is upwardly inclined from front to back at least 2 and preferably 3 inches with the slope thereof being no greater than 1:1. The upwardly inclined wall ends in a horizontal slot mating with the horizontal cross bar attached to the plate. The cross bar on the outer end has a retaining ring. The outer sidewall may be slotted to mate with this retaining ring.

A latch is mounted contiguous to the horizontal slot in the inner side wall and is adapted to engage and hold the horizontal cross bar in the slot.

The adapter has a mounting bar facing rearedly at the back of the vertical slot to rigidly slidingly engage one of the couplings of the vehicle and be pinned thereto.

The horizontal cross bars on the plates on the attachment or snowplow frame preferably is a single bar running between the two or three plates on the frame.

The latch preferably is a pivoting clip that upwardly rotates to the open position and is spring biased to the normally closed position about the horizontal cross bar. Preferably, the latch is operated by a cable pull from the cab of the vehicle. This enables one person to engage or disengage the adapter without leaving the cab of the vehicle providing a safe and easy method for either operation of the adapter.

Other than the use of the present adapter, the hookup and operation of the attachment are conventional. A hydraulic cylinder is attached to the frame by a chain and hook to permit the attachment to be raised or lowered in the normal manner.

THE DRAWINGS

In the drawings.

In the drawings, the same parts have the same numbers throughout.

DESCRIPTION

Figure 1:
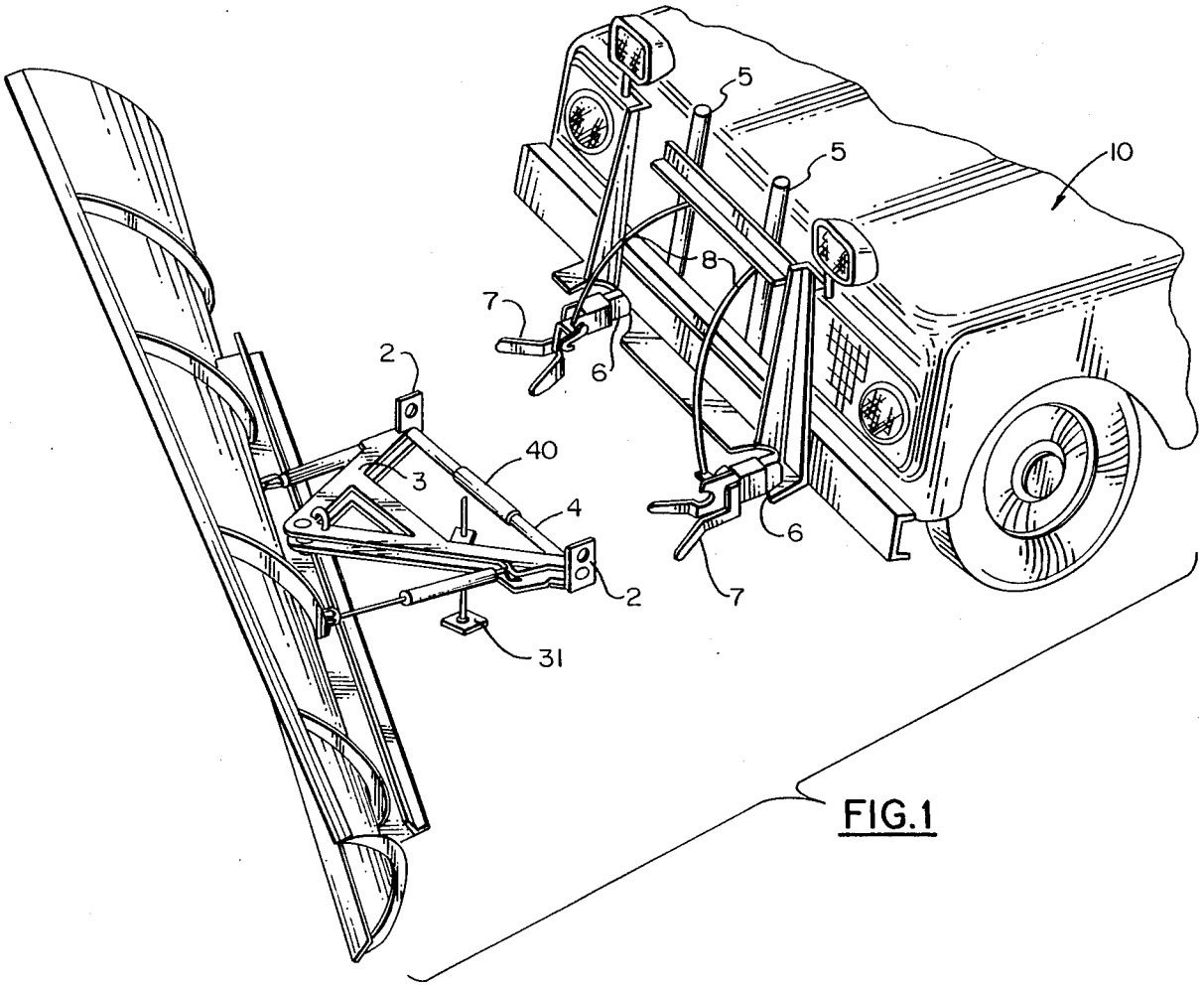
FIG. 1 is a perspective illustration showing the front end of the vehicle approaching a snowplow with the adapters of this invention in place, ready to acquire the snowplow.

Referring to FIG. 1 a snowplow 1 has conventional mounting plates 2 attached to a frame 3. The plates are rectangular in horizontal cross-section. In accordance with this invention a cross bar 4 is run through both plates 2 in one of the holes normally used to pin the plates into the mounting coupling on the frame of the vehicle.

The vehicle 10 to be attached to the snowplow has mounts 5 for supporting a conventional hydraulic cylinder/lift chain (not shown) which is to be attached to the snowplow 1 in the usual manner. Mounts 6 extend from the frame of the vehicle each of which consists of two arms spaced apart about one inch that normally would engage plates 2 and be pinned thereto. As anyone who has worked with snowplows knows, aligning the holes in plate 2 with the corresponding pins and holes in mounts 6 can be a devilish job especially when it is cold and the fingers are numb and tempers short.

The adapters 7 of this invention are mounted on the mounts 6 and pinned or bolted thereto. The rearward portions of adapters 7 preferably consist of an I-beam 17, the web of which fits between the two arms of mount 6 with the top and bottom plates fitting snugly over and under mount 6 so that when pinned thereto through the web a rather rigid connection is made.

Illustrated in FIG. 1 are cables 8 extending from the latch mechanism of adapter 7 through the engine compartment of the vehicle to the cab so that the cable pulls may be operated from the cab.

Figure 3:
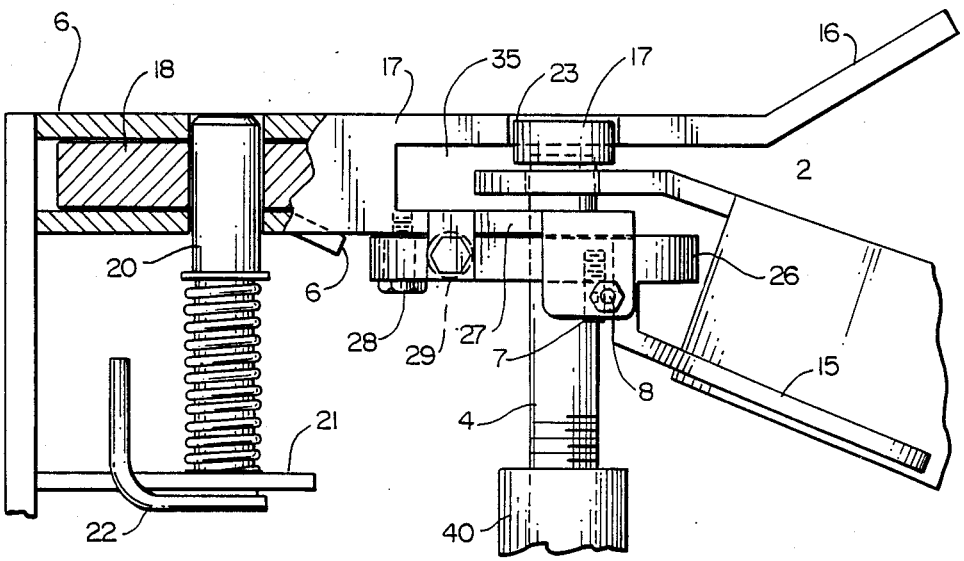
FIG. 3 is a top view of the adapter and also showing in part a mounting plate of a snowplow in place.
Figure 2:
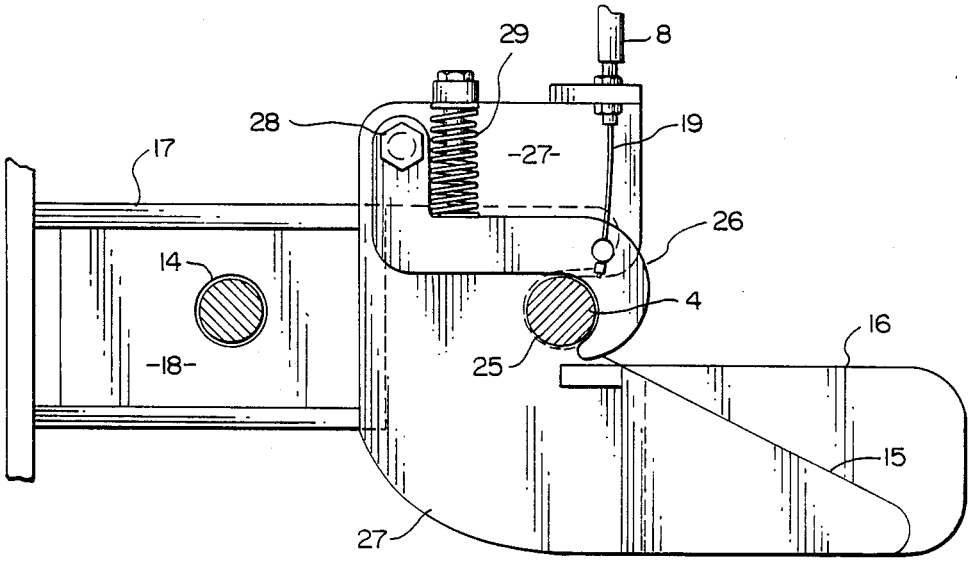
FIG. 2 is a side elevational view of the adapter.

Turning to FIGS. 2 and 3 the adapter of this invention will be explained in greater detail. The adapter has two vertical sidewalls 15 and 16. The leading edge of the inner sidewall 15 facing the snowplow is inclined upwardly a vertical distance of at least two inches at a slope no greater than 1:1. Sidewalls 15 and 16 extend rearedly and connect to an I-beam 17. Side wall 15 as illustrated is offset to accommodate the snowplow frame and terminates in a plate 27 which is attached to I-beam 17 and defines in part a slot 35. I-beam 17 is made to slide over and engage the conventional mounting coupling 6 on the vehicle. The I-beam has a hole 14 in the web 18 and a spring loaded pin 20 is inserted through it and the corresponding holes in the mounting coupling 6.

Pin 20 is supported on the frame in the usual manner by a bracket 21 and has a handle 22 to assist in retracting the pin when attaching the adapter. The adapters 7 of this invention once affixed to the frame usually remain there for the winter.

Sidewalls 15 and 16 diverge towards the snowplow preferably to a horizontal width of at least 4 inches which gives a great deal of latitude in the horizontal alignment. The two walls converge towards the rear before I-beam 17 to form a verticle slot 35 which receives plate 2. Slot 35 has about the same width as the slot in mounts 6, usually about 1 inch. The upwardly slanting wall 15 terminates in a slot 25 that receives cross bar 4. Bar 4 extends a little bit beyond plate 2 and is held therein by a retaining ring 11 at each end. If bar 4 does not protrude too far on the outside of plate 2 then only the inner wall 15 need be inclined to pick up the bar. As illustrated, wall 16 is slotted at 23 to receive retaining ring 11.

A clip 26 engages and holds bar 4 once it is in place in slot 25. It is spring biased by a spring 29 to be normally closed and is preferably operated by a cable 19 through cable connector 8 going to the cab of the vehicle.

The catch or clip 26 is mounted for upward rotation on plate 27 by a pin 28. Spring 29 is also mounted on plate 27.

As shown in FIG. 3, rod 4 may consist of two ends threaded into a tightening nut 40 which assists in tightening securing rod 4 to plates 2.

In operation, to detach the snowplow a pipestand 31 (FIG. 1) is dropped to support the snowplow. The operator pulls the cable releases 19 to lift up clips 26 and then simply backs the vehicle away. To attach the snowplow all that is necessary is to drive up to the snowplow with some reasonable degree of alignment and to continue forward at a slow pace to allow the sidewalls 15 and 16 of the adapter 7 to pick up bar 4 and to encompass plate 2. Further forward motion of the vehicle causes plate 2 to be guided into the verticle slot 35 provided by the sidewall and to lift bar 4 up and into slot 25. Clip 26 will be pushed up and when bar 4 is in place in slot 25 will automatically drop down and hold bar 4. If the snowplow is canted with respect to the vehicle with one adapter engaging a plate 2 before the other, continued forward motion will cause it to swivel and the other adapter to pick up its plate 2. Having made the connections to the vehicle all that remains is to lift stand 31 and clamp it in the up position and to attach the hook and chain going to the hydraulic lift cylinder (not illustrated).

What is claimed is:

1. An adapter effecting ready horizontal and vertical alignment and attachment of various auxiliary pieces of equipment to a vehicle, said equipment having a vertical plate extending rearwardly for attaching to a vehicle, said vehicle having a coupling mating with said vertical plate and attaching thereto by a means of a horizontal pin through said vertical plate, said coupling consisting to two forward projecting spaced apart arms, and said adapter in service being interposed between said vertical plate and said coupling and interconnecting the two, said adapter comprising:

a. a horizontal cross bar affixed to said plate;

b. two vertical side walls diverging towards said plate to an opening at the front thereof of at least four inches and closing at the other end to a vertical slot receiving said vertical plate, the inner of the said two vertical side walls (i) being upwardly inclinded from front to back at least two inches, the slope thereof being no greater than 1:1 and (ii) ending in a horizontal slot mating with said horizontal cross bar;

c. a latch mounted on said inner vertical side wall contiguous to said horizontal slot and adapted to engage and hold said horizontal cross bar in said horizontal slot, and d. mounting means holding said vertical side walls and facing rearwardly at the back of said vertical slot, rigidly mating with said coupling and adapted to be removably attached thereto, said mounting means comprising a horizontal I-beam the top and bottom plates of which extend over and firmly engage said spread apart arms and the web of which is pinned by a horizontal pin through said arms and web.

2. The adapter of claim 1 wherein there are two of said vertical plates, couplings, and adapters.

3. An adapter effecting ready horizontal and vertical alignment and attachment of a snowplow to a vehicle, said snowplow having two horizontally spaced apart vertical plates extending rearwardly for attaching to said vehicle, said vehicle having couplings mating with said vertical plates, each comprising two forwarding projecting spaced apart arms and each normally attaching to one of said vertical plates by a means of a horizontal pin through the arms and plate, said adapter in service being interposed between one of said vertical plates and the mating one of said couplings and interconnecting the two and said plates being modified to have a horizontal cross bar affixed to and between said plates; said adapter comprising:

a. two vertical side walls diverging towards said vertical plate mating therewith to an opening at the front thereof of at least four inches and closing at the other end to a vertical slot receiving one of said vertical plates, the inner of the said two vertical side walls (i) being upwardly inclined from front to back at least two inches, and (ii) ending in a horizontal slot mating with said horizontal cross bar;

b. a pivoting clip upwardly rotating to the open position mounted on said inner vertical side wall contiguous to said horizontal slot and adapted to engage and hold said horizontal cross bar in said horizontal slot, said pivoting clip being spring biased to the normally closed position, and c. mounting means holding said vertical side walls and facing rearwardly at the back of said vertical slot, rigidly mating with said coupling and adapted to be removably attached thereto, said mounting means comprising a horizontal I-beam the top and bottom flanges of which slide over and under and firmly engage said spaced apart arms and the web of which is pinned by said horizontal pin.

* * * * *